US006479814B2

(12) United States Patent
Shiokawa et al.

(10) Patent No.: US 6,479,814 B2
(45) Date of Patent: Nov. 12, 2002

(54) ION SOURCE FOR ION ATTACHMENT MASS SPECTROMETRY APPARATUS

(75) Inventors: Yoshiro Shiokawa, Hachioji (JP); Megumi Nakamura, Fuchu (JP); Toshihiro Fujii, Hamura (JP)

(73) Assignee: Anelva Corporation, Tokyo (JP)

( * ) Notice: Subject to any disclaimer, the term of this patent is extended or adjusted under 35 U.S.C. 154(b) by 0 days.

(21) Appl. No.: 09/814,799

(22) Filed: Mar. 23, 2001

(65) Prior Publication Data

US 2001/0023922 A1 Sep. 27, 2001

(30) Foreign Application Priority Data

Mar. 24, 2000 (JP) ..... 2000-085393

(51) Int. Cl.[7] ..... H01J 49/16
(52) U.S. Cl. ..... 250/283
(58) Field of Search ..... 250/283

(56) References Cited

PUBLICATIONS

Analytical Chemistry, vol. 48, No. 6, p825 (1976).

Analytical Chemistry, vol. 56, No. 3, p396 (1984).

Journal of Applied Physics, vol. 82, No. 5, p2056 (1997).

*Primary Examiner*—Bruce Anderson
*Assistant Examiner*—Zia R. Hashmi
(74) *Attorney, Agent, or Firm*—Oliff & Berridge, PLC

(57) ABSTRACT

An ion source of an ion attachment mass spectrometry apparatus has an emitter and a voltage-impressed portion for impressing a bias voltage to the emitter. In the ion source, the emitter is heated to emit positive charge metal ions that are attached to a detected gas to ionize it. By changing the material of the emitter, the electrical resistance between the ion emission point of the emitter and the reference-voltage-impressed portion of the voltage-impressed portion is reduced. By shortening the distance between the reference-voltage-impressed portion and the ion emission point, the electrical resistance between the ion emission point of the emitter and the reference-voltage-impressed portion of the voltage-impressed portion is reduced to not more than $10^{10}\Omega$. It is also possible to form a thin film emitter on the surface of the reference-voltage-impressed portion. Due to this, it is possible to suppress the occurrence of fluctuations in the potential difference between the ion emitter and the reference-voltage-impressed portion, stabilize the amount of ion emission, and analyze the mass with a high accuracy.

22 Claims, 6 Drawing Sheets

ION SOURCE FOR ION ATTACHMENT MASS SPECTROMETRY APPARATUS

BACKGROUND OF THE INVENTION

1. Field of the Invention

The present invention relates to an ion source for an ion attachment mass spectrometry apparatus, and more particularly, to an ion source used for an ion attachment mass spectrometry apparatus which attaches metal ions emitted from an emitter to a detected gas to ionize it and analyze the mass of the detected gas.

2. Description of the Related Art

In mass analysis of gas molecules, it has been necessary to give a positive or negative charge to the gas molecules in order to make use of the fact that the motion of charged particles in an electromagnetic field differs depending on the ratio between the charge and the mass. As methods for ionizing the gas molecules, there are the electron impact ionization method, the chemical ionization method, the atmospheric pressure ionization method, and the ion attachment ionization method, etc. Among these, the ion attachment ionization method enables ionization without dissociation (splitting) of the gas molecules including weak bonds since the excess energy arising in the process of ionization of a detected gas is extremely small. Therefore, in a mass spectrometry apparatus, it is possible to measure the correct molecular weight of a detected gas from the molecular ion peaks according to the ion attachment ionization method. This is effective for mass analysis of easily dissociating organic samples.

The ion attachment ionization method uses the phenomenon that when a metal oxide (insulator) is heated and metal atoms contained are emitted as ions, these metal ions gently deposit at locations where the charges of the gas molecules concentrate. In particular, if an oxide containing an alkali metal is heated, it is known that positive charge metal ions are easily emitted from the surface thereof. Attaching the alkali metal ions to other gas molecules to ionize them has been reported in *Analytical Chemistry,* vol. 48, no. 6, p. 825 (1976) as the Hodges system, in *Analytical Chemistry,* vol. 56, no. 3, p. 396 (1984) as the Bombick system, and in *Journal of Applied Physics,* vol. 82, no. 5, p. 2056 (1997) as the Fujii system.

Next, an explanation will be given of a conventional ion source used in a mass spectrometry apparatus employing the ion attachment ionization method with reference to FIG. 10 to FIG. 12. FIG. 10 is a schematic view of the configuration of the ion source, FIG. 11 is an enlarged sectional view of the emitter, and FIG. 12 is an equivalent circuit diagram of the emitter.

As shown in FIG. 10, the ion source employing the ion attachment ionization method is comprised of a conductive casing (container) 101 forming an ion attachment region inside it and having one end completely open, an aperture 102 attached to the right open end of the casing 101, a voltage-impressed portion 103 passing through a part of the casing 101 while electrically insulated from the same, a spherical emitter 104 comprised of a metal oxide attached to a suitable position of the voltage-impressed portion 103, and a gas inlet 105 for introducing a detected gas and other gases into the ion attachment region. The aperture 102 has an opening 106 for passing the ionized detected gas. By providing an insulator 107 at the connecting portion with the open end of the casing 101, it is electrically insulated from the casing 101. Further, the voltage-impressed portion 103 is connected to a heating power source 108 and a bias power source 109.

The spherical emitter 104, as shown in FIG. 11, is fixed by sintering for example to a wire-shaped voltage-impressed portion 103. The diameter of the emitter 104 is about 2 to 3 mm, for example. The portion of the voltage-impressed portion 103 in contact with the emitter 104 will be particularly referred to as a reference-voltage-impressed portion 103*a*. The emitter 104 is a mixture of an alumina silicate comprised of $Al_2O_3$ or $SiO_2$ and an oxide (compound) containing Li, that is, $Li_2O$, when the metal ions to be emitted from the emitter are $Li^+$ ions. These are all oxides, so form insulators overall. The specific resistance is also at least $10^{12}$ Ω·m. At least the reference-voltage-impressed portion is a wire-shaped structure of a high melting point metal such as Ir (iridium) or W (tungsten). In the reference-voltage-impressed portion, Joule heat is generated by the flow of current.

In the above ion source, the aperture 102 is held at the ground voltage and a mixed gas of the detected gas and another gas is introduced through the gas inlet 105 into the ion attachment region evacuated to a vacuum state. The inside is evacuated to a reduced pressure atmosphere of about 100 Pa. The other gas is a gas such as $N_2$ to which metal ions do not easily attach. This is introduced so as to rob the excess energy produced when the metal ions are attached to the detected gas. The voltage-impressed portion 103 is supplied with a bias voltage by the bias voltage source 109 so that the reference-voltage-impressed portion 103*a* becomes 10V, for example. Further, the heat source 108 lets a current flow at the reference-voltage-impressed portion 103*a* and thereby the emitter 104 is heated to about 600° C. Due to the above operation, metal ions ($Li^+$) are generated on the surface of the emitter 104. These metal ions are attracted by the electric field formed in the space 110 between the emitter 104 and the ground potential aperture 102, dissociated (emitted) from the surface of the emitter, and transported in the direction of the aperture 102. Next, the metal ions attach to the detected gas introduced into the ion source so as to ionize the detected gas.

In the above-described conventional ion source, the emitter is produced from an insulating metal oxide, so there was the problem that a potential difference between the reference-voltage-impressed portion 103*a* and the ion emission point on the surface of the emitter 104 cyclically changes. Since the emitter is an insulator, a large electrical resistor is interposed between the reference-voltage-impressed portion and the ion emission point. The above problem is caused by the fact that there is a voltage drop at the insulator.

FIG. 12 shows the portion between the reference-voltage-impressed portion and the ion emission point by an equivalent circuit. An electrical resistor 112 is interposed between the reference-voltage-impressed portion 103*a* and the ion emission point 111. In FIG. 12, when ions are emitted as shown by the arrows 113 from the emitter 104, a current flows through the electrical resistor 112 having a large resistance value. A voltage drop occurs here and the potential at the ion emission point 111 falls. The relation of the voltage drop is expressed as $$Vb=Va-I\cdot R \quad (1)$$

where the potential of the reference-voltage-impressed portion 103*a* is Va, the resistance of the emitter 104 is R, the current flowing through the emitter 104 is I, and the potential of the ion emission point 111 is Vb. Based on this relation, if the potential Vb at the ion emission point 111 falls, the electric field between the ion emission point 111 and the aperture 102 becomes weak, the amount of ion emission falls, and the current (I) flowing through the emitter 104 falls. If the current (I) falls, the voltage drop becomes smaller and the potential of Vb rises, so the amount of ion emission again increases. In this way, the process of "Vb drop→I fall→Vb rise→I rise→Vb drop" is repeated and an unstable cyclical change of the amount of ion emission and the electric field continues. In the ion attachment mass spectrometry apparatus, to accurately detect the number of molecules of the ionized detected gas as an electrical signal, that is, to correctly analyze the mass, the amount of ion emission has to be stable. Therefore, if such a cyclic state of change arises, it is not possible to correctly analyze the mass of the detected gas.

As a means for solving the above problems, if it is desirable to merely make the ratio of the change in potential at the ion emission point 111 smaller, it will be considered to increase the bias voltage applied to the reference-voltage-impressed portion 103*a*. However, if the bias voltage is increased, the energy of the ions emitted from the surface of the emitter also becomes higher. As a result, the energy of the emitted ions striking the detected gas becomes higher and the other problem of dissociation of the detected gas arises. In the ion attachment ionization method, it is necessary that the metal ions be attached to the detected gas gently by a low energy. Therefore, it is not possible to increase the bias voltage applied to the reference-voltage-impressed portion 103*a*.

SUMMARY OF THE INVENTION

An object of the present invention is to provide an ion source of an ion attachment mass spectrometry apparatus designed to suppress the occurrence of fluctuations in the potential difference between the ion emitter and the reference-voltage-impressed portion, stabilize the amount of ion emission, and enable high accuracy mass analysis.

The ion source of the ion attachment mass spectrometry apparatus according to the present invention is configured as follows to achieve the above object.

The ion source of the ion attachment mass spectrometry apparatus according to the present invention has an emitter containing a metal and a voltage-impressed portion impressing a bias voltage to the emitter. It heats the emitter to emit positive charge metal ions and attach the metal ions to the detected gas to ionize the gas. In this ion emission mechanism, by changing the material of the above emitter, the electrical resistance between the ion emission point of the emitter and the reference-voltage-impressed portion of the voltage-impressed portion is reduced.

In the above configuration, preferably, the material of the emitter is made a composite material of a compound containing a metal and a conductor. This composite material is a composite formed using either of the compound and the conductor as a base material and adding the other to it. Further, in the above configuration, preferably part of the material of the voltage-impressed portion is changed and that portion is formed as the emitter. The electrical resistance between the ion emission point and the reference-voltage-impressed portion is preferably not more than $10^{10}\Omega$. Further, the above conductor is preferably one of gold, carbon, iridium, platinum, tantalum, rhenium, molybdenum, and composites of the same.

Normally, the electrical resistance is proportional to the specific resistance. When the specific resistance is the same, the resistance is proportional to the length of the resistor and is inversely proportional to the sectional area. In the present invention, the material of the emitter for emitting the metal ions is made a composite material of a metal oxide and a conductor. Due to this, the specific resistance of the emitter falls and the electrical resistance between the reference-voltage-impressed portion and ion emission point is reduced. The composite material used in the present invention functions to reduce the specific resistance due to the functions arising from the combination of materials. Due to this, the electrical conductivity rises and it becomes possible to eliminate cyclic fluctuations at the time of ion emission.

The ion source of the ion attachment mass spectrometry apparatus having another configuration is an ion source having the same underlying configuration as the above. By shortening the distance between the reference-voltage-impressed portion of the voltage-impressed portion and the ion emission point of the emitter, the electrical resistance between the ion emission point and the reference-voltage-impressed portion is reduced to the value being not more than $10^{10}\Omega$.

In the above configuration, preferably, a thin film emitter is formed on the surface of the reference-voltage-impressed portion, or on the surface of the reference-voltage-impressed portion of a flat plate shape so as to shorten the distance between the ion emission point and the reference-voltage-impressed portion. Further, the above reference-voltage-impressed portion may be formed into a coil or hair pin shape.

In the above configuration, further, preferably the surface of the emitter is covered with a mesh like metal wire electrically conductive with the reference-voltage-impressed portion in a state of contact or else part or all of the surface of the emitter is covered with a conductive thin film having fine holes electrically conductive with the reference-voltage-impressed portion, whereby the electrical resistance between the ion emission point and the reference-voltage-impressed portion can be reduced and the distance between the two can be substantially reduced.

Here, the "distance between the two can be substantially reduced" means that, while the distance between the two is not physically shortened, a similar action and effect are caused as a result of the reduction of the electrical resistance.

In the second aspect of the present invention, a structure shortening the distance between the reference-voltage-impressed portion and the ion emission point was adopted for the emitter so as to reduce the electrical resistance between the reference-voltage-impressed portion and the ion emission point. This drop in the electrical resistance can be achieved by a structure increasing the sectional area of the emitter in a direction perpendicular to the flow of the current or a structure adopting the above configuration.

The above-mentioned configurations, as the ion source able to be used in the ion attachment mass spectrometry apparatus, can obtain stable signals without causing a change in the potential difference between the ion emission point and the reference-voltage-impressed portion.

Note that as the metal ions, preferably use is made of any of $Li^+$, $K^+$, $Na^+$, $Rb^+$, $Cs^+$, $Al^+$, $Ga^+$, and $In^+$.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Preferred embodiments of the present invention will be explained next with reference to the attached drawings.

The ion source of the ion attachment mass spectrometry apparatus according to the present invention is characterized in only the ion emission mechanism comprised of the emitter and the voltage-impressed portion (including the reference-voltage-impressed portion). The rest of the configuration is substantially the same as that of the related art. Therefore, in the following explanation of the embodiments, the explanation will mainly be made of only the ion emission mechanism. When an explanation of parts of the configuration other than the ion source in relation to the ion emission mechanism becomes necessary, the explanation will be given with reference to the configuration shown in the above-mentioned FIG. 10.

In explaining the embodiments of the present invention, mention will be made of the quantitative relation between the electrical resistance of the emitter and the fluctuation or change in the potential difference between the ion emission point of the surface of the emitter and the reference-voltage-impressed portion. The change in the potential difference at the potential Vb of the ion emission point is determined by the current I and the electrical resistance R based on the above formula (1). Further, to correctly analyze mass, the amount of ion emission (ion current) from the surface of the emitter has to be made at least about $10^{-10}$A. Further, to stably hold the electric field formed for transporting the ionized detected gas from the ion source to the outside mass spectrometry mechanism, the change in the potential difference between the reference-voltage-impressed portion and the ion emission point has to be made not more than 1V. Therefore, at this time, if the above electrical resistance is made not more than $10^{10}\Omega$ based on the formula (1), it is possible to satisfy the above request relating to the amount of ion emission. Therefore, in the following embodiments, the explanation will be given of the configuration for making the above electrical resistance not more than $10^{10}\Omega$.

Figure 1:
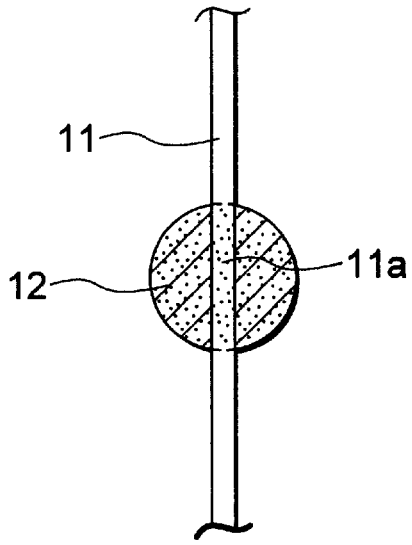
FIG. 1 is a longitudinal sectional view of principal parts showing a first embodiment of an ion emission mechanism of an ion attachment mass spectrometry apparatus according to the present invention.

Next an explanation will be made of a first embodiment of the present invention with reference to FIG. 1. The first embodiment makes the material of the emitter a composite material in order to reduce the electrical resistance between the reference-voltage-impressed portion and the ion emission point and reduce the specific resistance. FIG. 1 shows an ion emission mechanism attaching a spherical emitter 1 made of a composite material to the reference-voltage-impressed portion 11*a,* which is part of the voltage-impressed-portion 11, present inside the ion source.

The emitter 12 is made of a composite material increased in electrical conductivity by composing or adding a metal oxide (insulator) comprised of $Li_2O$, $Al_2O_3$, $SiO_2$, etc. and a conductor such as Au (gold), CB (carbon black), etc. The content of the conductor in the emitter 12 is made an amount giving an electrical resistance of the emitter of not more than $10^{10}\Omega$ as described above or an amount giving at least a limit composing or adding amount. The limit composing amount and the relation between this and the electrical resistance of not more than $10^{10}\Omega$ will be explained in detail later.

A bias voltage is impressed to the reference-voltage-impressed portion 11*a* from the bias voltage source 109 through the voltage-impressed portion 11 so that the potential becomes 10V and a current is passed through the heating power source 108. The emitter 12 attached to the reference-voltage-impressed portion 11*a* is heated to about 600° C. by the Joule heat and metal ions are produced on the surface. The metal ions are transported to the ion attachment region 110 in the aperture direction by the electric field formed by the potential difference between the ground potential aperture 102 and the emitter surface. A similar current as the emitted amount of ions flows between the reference-voltage-impressed portion 11*a* and the ion emission point of the surface of the emitter 12, a voltage drop occurs due to the electrical resistance of the emitter 12, and a potential difference arises between the reference-voltage-impressed portion 12 and the surface of the emitter. The emitter 12, however, is made by a composite material having a smaller specific resistance than the metal oxide and an improved electrical conductivity, therefore the amount of change of the potential at the ion emission point becomes smaller compared with the emitter of the related art.

The amount of ion emission required for accurately detecting the number of molecules of the ionized detected gas as an electrical signal is at least about $10^{-10}$A. Further, the emitter 12 is set to give an electrical resistance between the reference-voltage-impressed portion 12 and the ion emission point of not more than $10^{10}\Omega$. Therefore, the change in the potential at the ion emission point, according to the above formula (1), can be made not more than 1V. Therefore, the electric field formed by the potential difference between the aperture 102 and the ion emission point of the surface of the emitter 12 can be maintained at least at 90% at the time of start of ion emission, the cyclic fluctuations or changes can be suppressed, and the metal ions emitted from the ion emission point can be stably supplied to the ion attachment region 110. As a result, it is possible to correctly analyze the mass of the detected gas in the ion attachment mass spectrometry apparatus.

Next, a detailed explanation will be given of the method of producing the above composite material for the emitter 12. As the method of producing the composite material, sometimes the above metal oxide is made the base material and the above Au or other conductor is composed with (or filled in) it. For example, there are materials made using C (carbon) or W (tungsten) or another conductor as the base material and composing (filling) a metal oxide with it. The former conductor however is not limited to Au or CB, while the latter conductor is not limited to C or W. The material may be any which has a high electrical conductivity, a high melting point, and a superior corrosion resistance. Here, CB is fine carbon obtained by a combination of thermal decomposition of natural gas, oil, creosote oil, or another hydrocarbon and incomplete combustion.

As the method for giving conductivity to an insulator, in general, there is known the method of combining CB with, for example, nylon 6 or SBR (styrene butadiene rubber) or another synthetic resin. The electrical conductivity obtained by bonding etc. CB with a base material of a synthetic resin etc. differs somewhat by the size of the particles of the base material and the surface tension of the base material, but is substantially determined by the amount of composing (filling) of CB. The relation between the amount of increase of the CB contained and the electrical conductivity becomes as follows.

When the CB starts to be composed with the insulator, the electrical conductivity increases extremely slightly, but when a certain limit composing amount (limit filling amount) is reached, the electrical conductivity of the composite material increases transitionally (rapidly) and then returns to its slow increase once again. This limit composing amount, when expressed in terms of vol %, is a small amount of not more than 0.3% for nylon 6, and not more than 0.2% for SBR, for example.

The material of the emitter 12 according to the present embodiment as explained above is preferably a composite material comprised of the metal oxide containing at least the limit composing amount of a conductor. By combining a conductor with a metal oxide having a specific resistance of about $10^{12}\ \Omega\cdot m$, the specific resistance of the emitter is made relatively low and the amount of ion emission is stabilized. When the composing amount of the conductor is not more than the limit composing amount and the electrical resistance between the reference-voltage-impressed portion and the ion emission point becomes not more than $10^{10}\Omega$, the composing amount of the conductor may be not more than limit composing amount.

Figure 2:
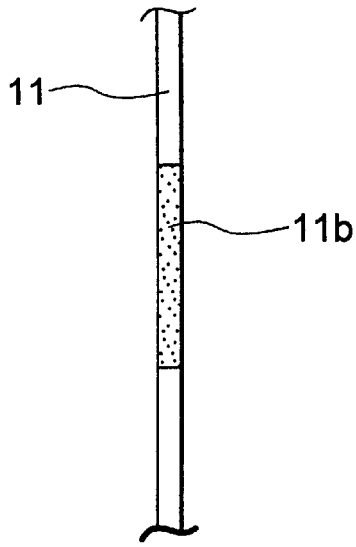
FIG. 2 is a longitudinal sectional view of principal parts showing a second embodiment of an ion emission mechanism of an ion attachment mass spectrometry apparatus according to the present invention.

Next, a second embodiment of the present invention will be explained with reference to FIG. 2. In the second embodiment, an ion emission mechanism sharing the functions of the emitter and the reference-voltage-impressed portion is formed by making a part of the voltage-impressed portion present inside the ion source a composite material. That is, by forming the part 11*b* of the voltage-impressed portion 11 present inside the ion source by a composite material comprised of the above $Li_2O$ or other metal oxide and at least the limit composing amount of W or other conductor, an emission portion having the functions of both the above-mentioned emitter 12 and the reference-voltage-impressed portion 11*a* is formed at the voltage-impressed portion. The method of making this emission portion is to burn Li or a compound containing Li etc., insert part (the part 11*b*) of the voltage-impressed portion 11 in the flame to attach or diffuse the Li to or in it, and thereby incorporate the Li inside. As a result, if the part 11*b* of the voltage-impressed portion 11 formed in this way is heated in the state with a bias voltage applied, it becomes possible to stably supply metal ions from the part 11*b* of the voltage-impressed portion 11 to the ion attachment region.

Further, as another method of forming an emission portion (11*b*) having the same shape as the voltage-impressed portion (11), it is also possible to compose at least a limit composing amount of a conductor to a metal oxide of a wire structure, make the two ends attachable to the front ends of different voltage-impressed portions, and electrically connect these to form a bias impressing circuit when operating the ion source of the ion attachment mass spectrometry apparatus.

According to the ion emission mechanism of the ion source according to the second embodiment, by doping part of the voltage-impressed portion 11 as explained above, an emission portion 11*b* corresponding to the above emitter is formed. Therefore, it is possible to reduce the electrical resistance, which had caused cyclic fluctuations in the amount of ion emission, in a preferable state and possible to stabilize the amount of ion emission.

Figure 3:
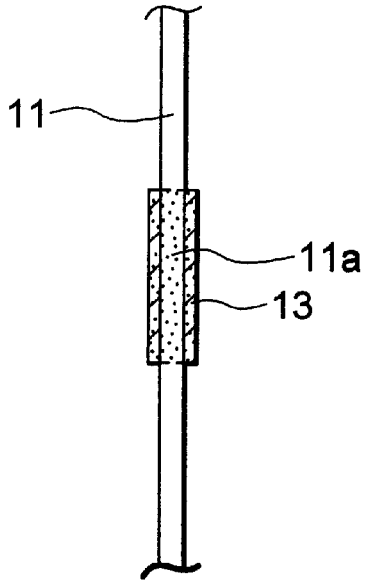
FIG. 3 is a longitudinal sectional view of principal parts showing a third embodiment of an ion emission mechanism of an ion attachment mass spectrometry apparatus according to the present invention.

Next, a third embodiment of the present invention will be explained with reference to FIG. 3. In the third embodiment, the ion emission mechanism is formed by depositing a thin film 13 comprised of a metal oxide around the reference voltage impressed portion 11*a,* that is, the part of the voltage impressed portion present inside the ion source. Specifically, a thin film 13 of a metal oxide such as $Li_2O$ is coated on the circumferential surface of the reference-voltage-impressed portion 11*a* produced by W or Ir etc. The thin film 13 functions as an emitter. In the ion emission mechanism according to this embodiment, since the emitter is formed as a thin film 13, it is possible to shorten the distance between the reference-voltage-impressed portion 11*a* and the ion emission point and possible to reduce the electrical resistance between them. Due to this, it is possible to stabilize the amount of ion emission from the thin film 13 functioning as the emitter.

In the ion emission mechanism of the present embodiment as well, the electrical resistance of the emitter is generally set to about $10^{10}\Omega$ as explained above. In the above metal oxide, the specific resistance is generally about $10^{12}\ \Omega\cdot m$, so if the thin film 13 deposited on the circumferential surface of the reference voltage impressed portion 11*a* is made a metal oxide of a uniform thickness of 0.5 $\mu$m, from the formula $R=\sigma\cdot L/S$ (R: electrical resistance, $\sigma$: specific resistance, L: length, and S: sectional area) . . . (2), the sectional area of the thin film 13 in the direction perpendicular to the flow of current has to be about $5\times10^{-5}\ m^2$. The sectional area of the thin film 13 in the direction perpendicular to the flow of current may be considered to be substantially equal to the surface area of the reference-voltage-impressed portion 11*a,* so if the reference-voltage-impressed portion 11*a* is made a wire structure with a diameter of 0.25 mm, the length of the region of the thin film 14 deposited on the reference-voltage-impressed portion 11*a* becomes about 6.37 cm.

In the present embodiment, the thin film 13 forming the emitter was formed by a metal oxide such as $Li_2O$, but the specific resistance is determined by the ratio of mixture or the concentration of impurities, so cannot be specified. When the specific resistance of the metal oxide used for deposition of the thin film 13 is much higher than the above $10^{12}$ Ω·m, the thin film 13 is deposited thinner than the above thickness on the reference-voltage-impressed portion 11*a* and over a broader area.

Figure 4:
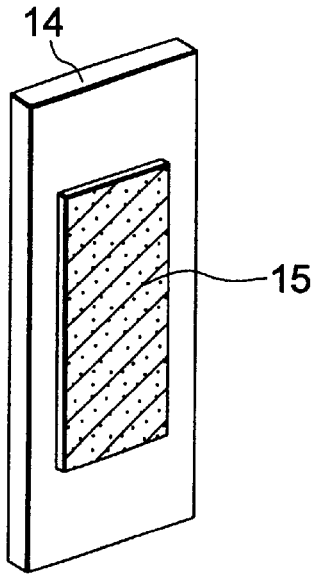
FIG. 4 is a longitudinal sectional view of principal parts showing a fourth embodiment of an ion emission mechanism of an ion attachment mass spectrometry apparatus according to the present invention.

Next, an explanation will be given of a fourth embodiment of the present invention with reference to FIG. 4. In the fourth embodiment, the reference-voltage-impressed portion of the voltage-impressed-portion present in the ion source is made to have a flat plate shape and a thin film 15 of a metal oxide forming an emitter is deposited on the surface of the reference-voltage-impressed portion 14 of the flat plate to form an ion emission mechanism. In FIG. 4, the reference-voltage-impressed portion 14 is formed as a flat plate of for example a length of 16 cm, a width of 5 cm, and a thickness of 2.5 cm. In the reference-voltage-impressed portion 14, the sectional area in the direction perpendicular to the flow of current becomes 80 $cm^2$. When the thickness of the thin film 15 is uniform, in the case of a thickness of 0.1 μm, it is possible to use a metal oxide having a specific resistance of about $10^{15}$ Ω·m for the formation of the thin film 15. Further, when using a metal oxide having a specific resistance of not more than $10^{15}$ Ω·m, even if the amount of ion emission from the emitter, that is, the thin film 15, is increased to obtain a higher sensitivity, the fluctuation in the potential difference between the reference voltage impressed portion and the ion emission point can be reduced to not more than 1V.

Figure 5:
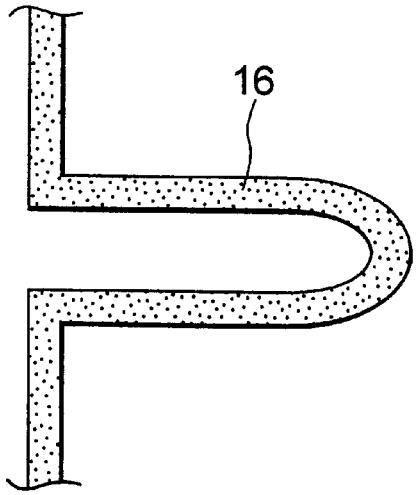
FIG. 5 is a longitudinal sectional view of principal parts showing a fifth embodiment of an ion emission mechanism of an ion attachment mass spectrometry apparatus according to the present invention.
Figure 6:
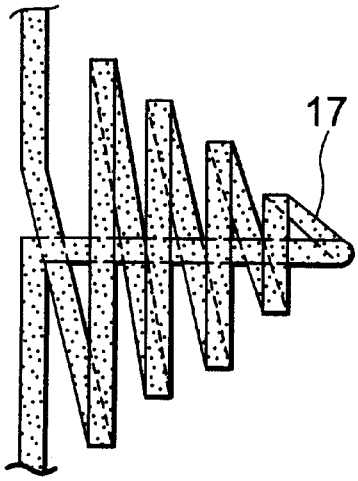
FIG. 6 is a longitudinal sectional view of principal parts showing a sixth embodiment of an ion emission mechanism of an ion attachment mass spectrometry apparatus according to the present invention.

Next, an explanation will be made of a fifth embodiment and a sixth embodiment with reference to FIG. 5 and FIG. 6. In the fifth embodiment shown in FIG. 5, for example, a large number of reference voltage impressed portions are interposed in the ion source by forming a reference-voltage-impressed portions 16 comprised of Ir wire into hair pin shapes. Due to this, it is possible to increase the region in which the metal oxide can be deposited and further to deposit the metal oxide uniformly to increase the sectional area in the direction perpendicular to the flow of current in the emitter. Further, in the sixth embodiment shown in FIG. 6, a larger number of reference-voltage-impressed portions 17 are interposed in the ion source by making the shape of the reference-voltage-impressed portions comprised of the Ir wire coil shapes. A thin film forming an emitter is uniformly deposited on the surface of the reference-voltage-impressed portion 17. By increasing the region in which the metal oxide can be deposited in this way and depositing the metal oxide on it uniformly, it is possible to increase the sectional area in the direction perpendicular to the flow of current in the emitter. In the case of the above hair pin shape and coil shape, it is possible to concentrate the emission of ions from the surface of the emitter, that is, thin film, near the center axis passing through the opening of the aperture, so it is possible to increase the detection sensitivity.

Note that the shape and dimensions of the reference-voltage-impressed portion are not limited to the above. It is sufficient that the region in which the emitter inside the ion source (metal oxide) can be deposited be increased. Further, when the metal oxide deposited on it is made an electrical resistance of not more than $10^{10}$Ω, the dimensions need only satisfy the above formula (2).

Figure 7A:
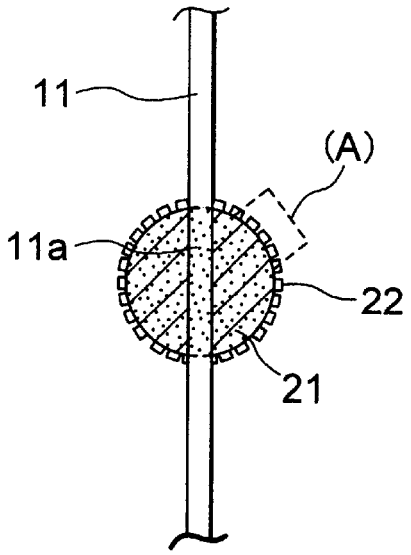
FIG. 7A is a longitudinal sectional view of principal parts showing a seventh embodiment of an ion emission mechanism of an ion attachment mass spectrometry apparatus according to the present invention.
Figure 7B:
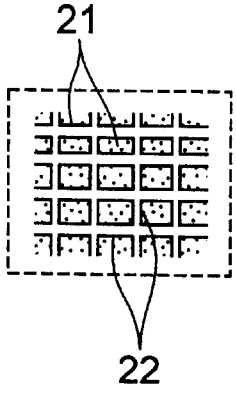
FIG. 7B is a partial enlarged front view of the seventh embodiment.

An explanation will be made of a seventh embodiment of the present invention with reference to FIG. 7A and FIG. 7B. FIG. 7B shows the enlarged figure of the portion (A) of FIG. 7A. In this embodiment, the ion emission mechanism is formed by forming a second reference-voltage-impressed portion 22 comprised of a mesh conductor at an emitter 21 of the metal oxide provided on the reference-voltage-impressed portion 11*a* being the part of the voltage-impressed portion 11.

In the second reference-voltage-impressed portion 22, the conductor is formed as a mesh in close contact with the surface of the emitter 21. This mesh conductor is comprised of Ir wire or W wire etc. of a diameter of 10 μm, for example. The exposed part of the surface of the emitter 21 surrounded by these conductors is comprised of at least 400 fine parts, that is, 400 mesh, per 25 mm×25 mm region as shown in FIG. 7B. According to the above configuration, the distance between the ion emission point in the exposed surface and the second reference voltage impressed portion 22 can be made shorter and the effect of the voltage drop can be reduced.

Figure 8A:
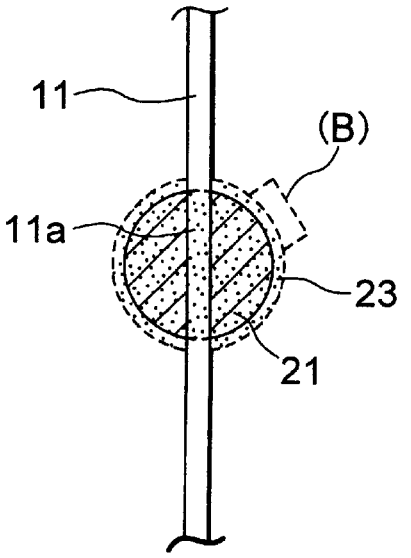
FIG. 8A is a longitudinal sectional view of principal parts showing an eighth embodiment of an ion emission mechanism of an ion attachment mass spectrometry apparatus according to the present invention.
Figure 8B:
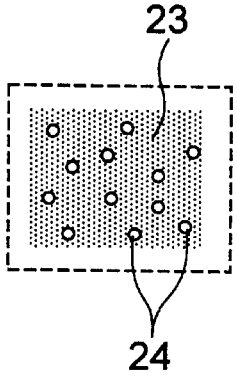
FIG. 8B is a partial enlarged front view of the eighth embodiment.

An eighth embodiment of the present invention will be explained next with reference to FIG. 8A and FIG. 8B. FIG. 8B shows the enlarged figure of the portion (B) in FIG. 8A. In this embodiment, a second reference-voltage-impressed portion 23 comprised of a conductor is coated over the surface of the emitter 21 of the metal oxide provided on the reference-voltage-impressed portion 11*a* being the part of the voltage-impressed portion 11 to form the ion emission mechanism.

The second reference-voltage-impressed portion 23 is a conductor coated in a thin film on the surface of the emitter 21. If the surface of the emitter 21 is covered completely in this way, the flight space of the ions emitted from the surface of the emitter ends up being blocked and ions can no longer be supplied to the ion attachment region. Therefore, the second reference-voltage-impressed portion 23, as shown in FIG. 8B, is formed with a large number of fine holes 24 passing through the second reference-voltage-impressed portion 23 in its surface. Due to this, the flight space of the ions emitted from the surface of the emitter 21 is secured.

The total of the open area of the holes 24 formed at the second reference-voltage-impressed portion 23 is preferably at least 10% of the surface area of the emitter 21. This is because when the ions emitted from the surface of the emitter 21 ionize the detected gas for mass analysis, the amount necessary for accurately detecting the number of molecules as an electrical signal is secured.

In the above explanation of the embodiments of the present invention, the components and structure were only shown schematically to an extent enabling understanding of the present invention. Further, the dimensions and the compositions of the materials etc. were only illustrations. Further, the method of heating the emitter according to the present invention is not limited to the conventional method of using a heating power source connected to the voltage-impressed portion to supply a current to the voltage-impressed portion and the reference-voltage-impressed portion to generate Joule heat and utilizing that Joule heat to heat the emitter.

Figure 9:
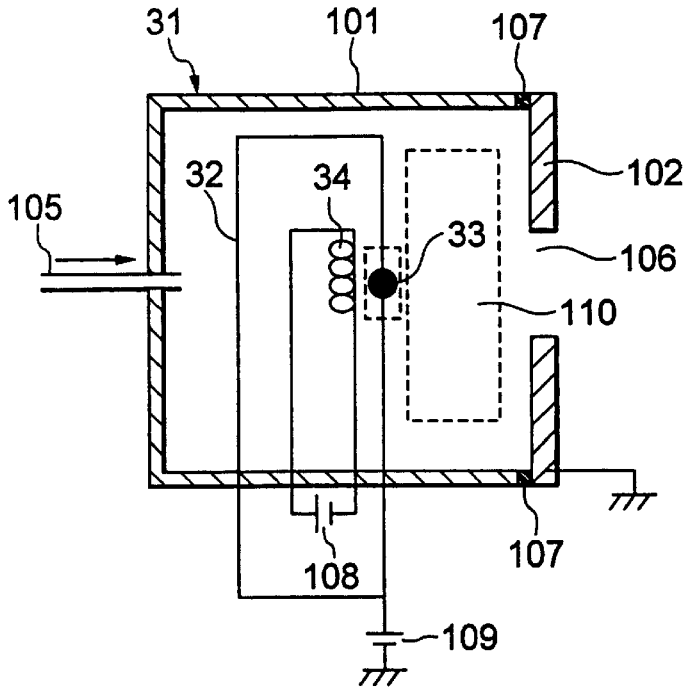
FIG. 9 is a schematic view of the configuration of an ion emission mechanism of an ion attachment mass spectrometry apparatus according to the present invention.
Figure 10:
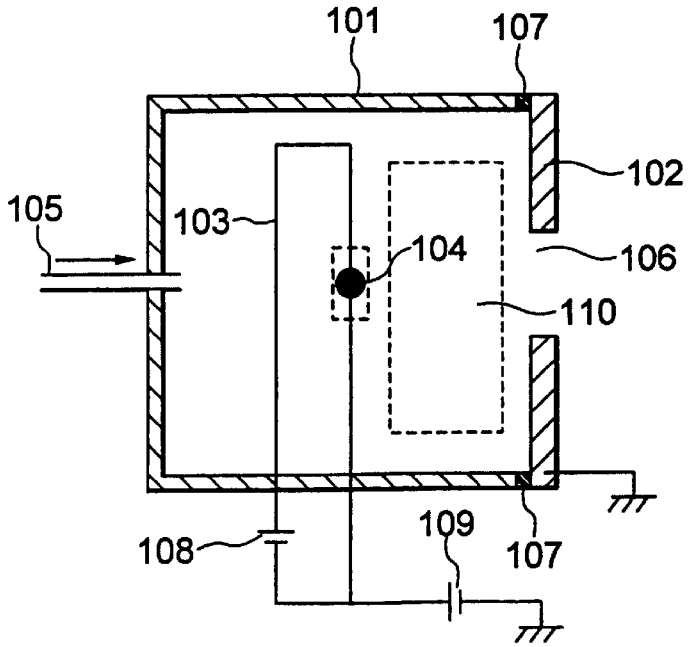
FIG. 10 RELATED ART
FIG. 10 is a schematic view of the configuration of an ion emission mechanism of an ion attachment mass spectrometry apparatus of the related art.
Figure 11:
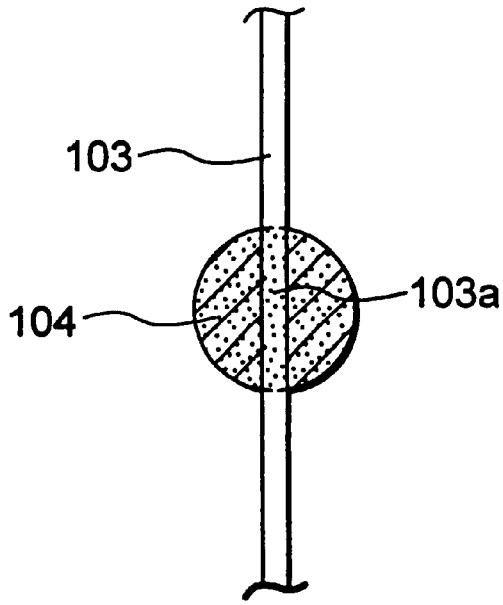
FIG. 11 RELATED ART
FIG. 11 is a longitudinal sectional view of principal parts of an ion emission mechanism of the related art.
Figure 12:
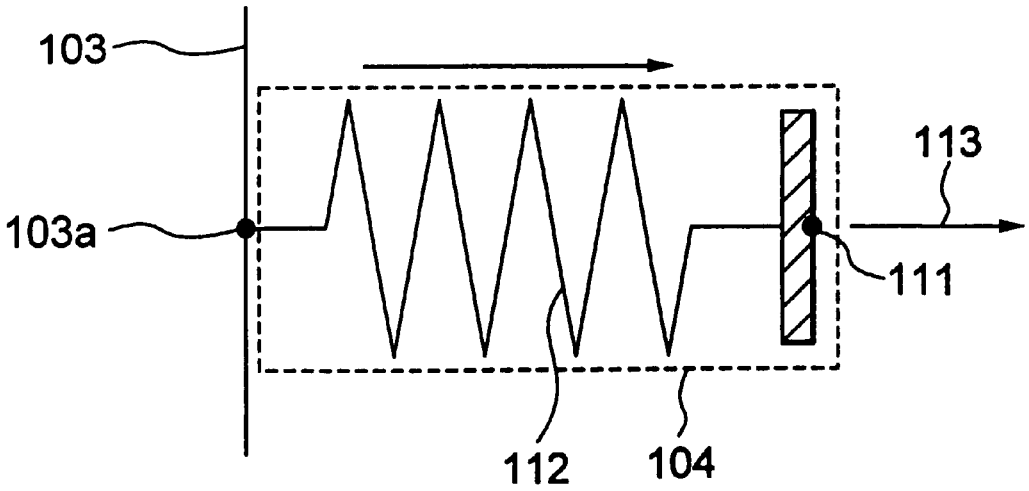
FIG. 12 RELATED ART
FIG. 12 is a circuit diagram showing an ion emission mechanism of the related art by an equivalent circuit.

For example, as shown in FIG. 9, it is also possible to arrange a heater 34 comprised of a conductor with a somewhat high electrical resistance in the region opposite to the ion attachment region seen from the emitter 33 and the reference-voltage-impressed portion near the emitter 33 attached to the reference-voltage-impressed portion being the part of the voltage-impressed portion 32 in the ion source 31. It is also possible to use a means for supplying a current to the heater 34 by the heating power source 35 to generate heat and heating the emitter 33 by the radiant heat at that time. Note that in FIG. 9, elements substantially the same as the elements explained in FIG. 10 are given the same reference numerals.

Further, the above embodiments are respectively not limited to those embodiments alone. Of course it is also possible to combine these embodiments to prevent fluctuations in the potential difference between the reference-voltage-impressed portion and the ion emission point.

According to the present invention, in the ion attachment mass spectrometry apparatus, since the ion emission mechanism in the ion source is made using a composite material for the emitter or configuring the emitter to shorten the distance between the ion emission point and the reference-voltage-impressed portion, it is possible to reduce the electrical resistance between the ion emission point and the voltage-impressed-portion and therefore possible to reduce the change in potential at the ion emission point and possible to stably supply metal ions to the ion attachment region. As a result, it is possible to ionize the detected gas by the ion attachment ionization method and correctly analyze the mass of the detected gas.

While the invention has been described with reference to specific embodiment chosen for purpose of illustration, it should be apparent that numerous modifications could be made thereto by those skilled in the art without departing from the basic concept and scope of the invention.

What is claimed is:

1. An ion source attachment mass spectrometry apparatus comprising:

an emitter containing a metal, which is heated to cause emission of positive of emission of positive charge metal ions from said metal and said emitted metal ions are attached to a detected gas to ionize it; and a voltage-impressed portion for impressing a bias voltage to said emitter;

wherein a material of said emitter has conductivity to reduce electrical resistance between an ion emission point of said emitter and a reference-voltage-impressed portion of said voltage-impressed portion.

2. An ion source of an ion attachment mass spectrometry apparatus as set forth in claim 1, wherein said material of said emitter is a composite material of a conductor and a compound containing the metal.

3. An ion source of an ion attachment mass spectrometry apparatus as set forth in claim 2, wherein said composite material is a composite formed using one of said conductor and said compound as a base material and adding the other to the base material.

4. An ion source of an ion attachment mass spectrometry apparatus as set forth in claim 1, wherein material of a part of said voltage-impressed portion is changed and said part is formed as said emitter.

5. An ion source of an ion attachment mass spectrometry apparatus as set forth in claim 1, wherein the electrical resistance between said ion emission point and said reference-voltage impressed portion is made not more than $10^{10}\Omega$.

6. An ion source of an ion attachment mass spectrometry apparatus as set forth in claim 1, wherein said conductor is selected from the group consisting of gold, carbon, iridium, platinum, tantalum, rhenium, molybdenum, tungsten and their composites.

7. An ion source of an ion attachment mass spectrometry apparatus as set forth in claim 1, wherein said metal ions are selected from the group consisting of $Li^+$, $K^+$, $Na^+$, $Rb^+$, $Cs^+$, $Al^+$, $Ga^+$ and $In^+$.

8. An ion source of an ion attachment mass spectrometry apparatus comprising:

an emitter containing a metal, which is heated to cause emission of positive charge metal ions from said metal and said emitted metal ions are attached to a detected gas to ionize it; and a voltage-impressed portion for impressing a bias voltage to said emitter;

wherein electrical resistance between a reference-voltage-impressed portion of said voltage-impressed portion and an ion emission point of said emitter is reduced to a value not more than $10^{10}\Omega$.

9. An ion source of an ion attachment mass spectrometry apparatus as set forth in claim 8, wherein said emitter is formed to be of a thin film shape on the surface of said reference-voltage-impressed portion.

10. An ion source of ion attachment mass spectrometry apparatus as set forth in claim 8, wherein said reference-voltage-impressed portion has a flat-plate shape.

11. An ion source of an ion attachment mass spectrometry apparatus as set forth in claim 8, wherein said reference-voltage-impressed portion is made a coil shape.

12. An ion source of an ion attachment mass spectrometry apparatus as set forth in claim 8, wherein said reference-voltage-impressed portion is made a hair pin shape.

13. An ion source of an ion attachment mass spectrometry apparatus comprising:

an emitter containing a metal, which is heated to cause emission of positive charge metal ions from said metal and said emitted metal ions are attached to a detected gas to ionize it; and a voltage-impressed portion for impressing a bias voltage to said emitter, wherein the surface of said emitter is covered with a mesh metal wire electrically conductive with said reference-voltage-impressed portion in a state of contact.

14. An ion source of an ion attachment mass spectrometry apparatus comprising:

an emitter containing a metal, which is heated to cause emission of positive charge metal ions from said metal and said emitted metal ions are attached to a detected gas to ionize it; and a voltage-impressed portion for impressing a bias voltage to said emitter, wherein a part or all of the surface of said emitter is covered with a conductive thin film having fine holes electrically conductive with the reference-voltage-impressed portion.

15. An ion source of an ion attachment mass spectrometry apparatus as set forth in claim 8, wherein the metal ions are selected from the group consisting of $Li^+$, $K^+$, $Na^+$, $Rb^+$, $Cs^+$, $Al^+$, $Ga^+$ and $In^+$.

16. An ion source of an ion attachment mass spectrometry apparatus as set forth in claim 13, wherein the metal ions are any one of $Li^{+,\,K+}$, $Na^+$, $Rb^+$, $Cs^+$, $Al^+$, $Ga^+$ and $In^+$.

17. An ion source of an ion attachment mass spectrometry apparatus as set forth in claim 14, wherein the metal ions are any one of $Li^{+,\,K+}$, $Na^+$, $Rb^+$, $Cs^+$, $Al^+$, $Ga^+$ and $In^+$.

18. An ion source of an ion attachment mass spectrometry apparatus as set forth in claim 1, wherein said voltage-impressed portion has a loop shape with a disconnected part and said emitter is formed to have the same shape as said voltage-impressed portion and is attached to or removed from said disconnected part as an emission portion of said voltage-impressed portion.

19. An ion source of an ion attachment mass spectrometry apparatus as set forth in claim 2, wherein said voltage-impressed portion has a loop shape with a disconnected part and said emitter is formed to have the same shape as said voltage-impressed portion and is attached to or removed from said disconnected part as an emission portion of said voltage-impressed portion.

20. An ion source of an ion attachment mass spectrometry apparatus as set forth in claim 3, wherein said voltage-impressed portion has a loop shape with a disconnected part and said emitter is formed to have the same shape as said voltage-impressed portion and is attached to or removed from said disconnected part as an emission portion of said voltage-impressed portion.

21. An ion source of an ion attachment mass spectrometry apparatus as set forth in claim 13, wherein electrical resistance between an ion emission point of said emitter and said mesh metal wire or said conductive thin film electrically conductive with said reference-voltage-impressed portion is a value not more than $10^{10}\Omega$.

22. An ion source of an ion attachment mass spectrometry apparatus as set forth in claim 14, wherein electrical resistance between an ion emission point of said emitter and said mesh metal wire or said conductive thin film electrically conductive with said reference-voltage-impressed portion is a value not more than $10^{10}\Omega$.

* * * * *